United States Patent [19]

Murphy et al.

[11] 4,241,909

[45] Dec. 30, 1980

[54] DOCUMENT STACKING APPARATUS

[75] Inventors: Gary J. Murphy, Potomac; George F. Norris, Kensington, both of Md.

[73] Assignee: Input Business Machines, Inc., Rockville, Md.

[21] Appl. No.: 926,729

[22] Filed: Jul. 21, 1978

[51] Int. Cl.[3] ..... B65H 29/68

[52] U.S. Cl. ..... 271/182; 271/220

[58] Field of Search ..... 271/174, 182, 184, 220, 271/223, 224

[56] References Cited

U.S. PATENT DOCUMENTS

| | | | |
|---|---|---|---|
| 2,797,098 | 6/1957 | Brodie | 271/178 |
| 3,078,089 | 2/1963 | Maidment | 271/177 X |
| 3,517,926 | 6/1970 | Oram | 271/224 |
| 3,865,365 | 2/1975 | Hardin | 271/178 X |
| 3,870,294 | 3/1975 | Donner | 271/122 |

*Primary Examiner*—Richard A. Schacher

*Attorney, Agent, or Firm*—Haight, Rosfeld, Noble & Santa Maria

[57] ABSTRACT

Document stacking apparatus for continuously stacking a plurality of documents in the sequential order in which they are fed into the apparatus is disclosed. Motor driven feed rollers feed the documents into the apparatus and along a predetermined path defined by guide plates and a deflector. A stacking bed is provided for supporting the documents in a stacked arrangement and a moveable baffle is mounted upon the stacking bed for defining a stacking cavity with the guide plates. The stacking bed is inclined with respect to a horizontal plane and is also provided with an inclined slot. A follower is fixedly secured to the baffle and slidably disposed within the slot whereby the baffle is gravity-biased toward a first position so as to normally minimize the stacking cavity. The baffle is also movable, under the influence of the incoming documents to be stacked, against the gravity-bias toward a second position so as to expand the stacking cavity and thereby accommodate successive documents to be stacked. A roller mechanism, rotatable in a direction counter to that which would normally feed the documents along the predetermined path, is also provided for retarding the movement of the documents and facilitating their stacked arrangement within the stacking cavity.

5 Claims, 5 Drawing Figures

DOCUMENT STACKING APPARATUS

BACKGROUND OF THE INVENTION

The present invention relates generally to sheet or document stacking machines and more particularly to a low-speed sheet or document stacking machine which is capable of stacking sheets or documents, characterized by varying thicknesses, dimensions, textures or surface finishes, in the original sequential order in which the documents were initially fed into the machine.

Within various commercial establishments, the need for low-speed document stacking apparatus is of paramount importance in order to achieve an efficient administrative processing operations. In addition, the stacking apparatus must be capable of processing documents having quite diverse characteristics, e.g. varying thicknesses, dimensions, textures and surface finishes, such that all of the documents may be processed continuously. Otherwise, documents having similar characteristics would be required to be preliminarily separated from the remaining documents and then each separate stack of documents processed. This obviously necessitates multiple handling procedures and an inordinate expenditure of personnel time.

Banks and other similar institutions, for example, are required to process a multitude of different documents pertaining to their daily customer operations. Such documents may include, for example, checks drawn on banks located throughout the world, deposit slips, payment coupons, debit notices, shipping memoranda accompanying new checks and the like. Such documents will, of course, be of various sizes amd will have varying thickness, textures and surface finishes. The need is therefore apparent for machinery which can continuously process such diverse documents in conjunction with, for example, scanning, verifying, counting or other similar apparatus, and stack the documents in the original sequential order in which the documents are initially fed from such auxiliary scanning or the like apparatus.

OBJECTS OF THE INVENTION

Accordingly, it is a general object of the present invention to provide a new and improved document stacking apparatus.

Another object of the present invention is to provide a new and improved document stacking apparatus which can continuously process documents at a good rate of speed.

A further another object of the present invention is to provide a new and improved document stacking apparatus which is capable of stacking documents characterized by varying dimensions, thicknesses, textures, surface finishes or other similar parameters.

Yet another object of the present invention is to provide new and improved document stacking apparatus which is capable of stacking documents in the original sequential order in which the documents are initially fed into the stacking apparatus.

Upon study of the specification and appended claims, further objects, features and advantages of the present invention will become more fully apparent to those skilled in the art to which this invention pertains.

SUMMARY OF THE INVENTION

Briefly, the above and other objects are attained in one aspect of the present invention by providing a document stacking apparatus which comprises motor driven feed rollers for feeding the documents into the apparatus and along a predetermined flow path defined by guide plates and a deflector. A stacking bed is provided for supporting the documents in a stacked arrangement and a movable baffle is mounted upon the stacking bed for defining a stacking cavity with the guide plates. The stacking bed is inclined with respect to a horizontal plane and an inclined slot is also defined within the bed. A follower is fixedly secured to the baffle and slidably disposed within the slot; in this manner, the baffle is gravity-biased toward a first position so as to normally minimize the volume of the stacking cavity. The baffle is also movable, under the influence of the incoming documents to be stacked, against the gravity-bias toward a second position so as to expand the volume of the stacking cavity and thereby accommodate successive documents automatically.

A roller mechanism, rotatable in a direction counter to that which would normally feed the documents along the predetermined path, is disposed within the path for retarding the movement of the documents along the path. In this manner, the documents are prevented from escaping from the stacking cavity and stacking of the documents within the cavity is facilitated.

BRIEF DESCRIPTION OF THE DRAWINGS

The above and other objects, features and advantages of the present invention will be more fully apparent from the following detailed description when considered in connection with the accompanying drawings, in which like reference charactes designate like or corresponding parts throughout the several views, and wherein.

DETAILED DESCRIPTION

Figure 1:
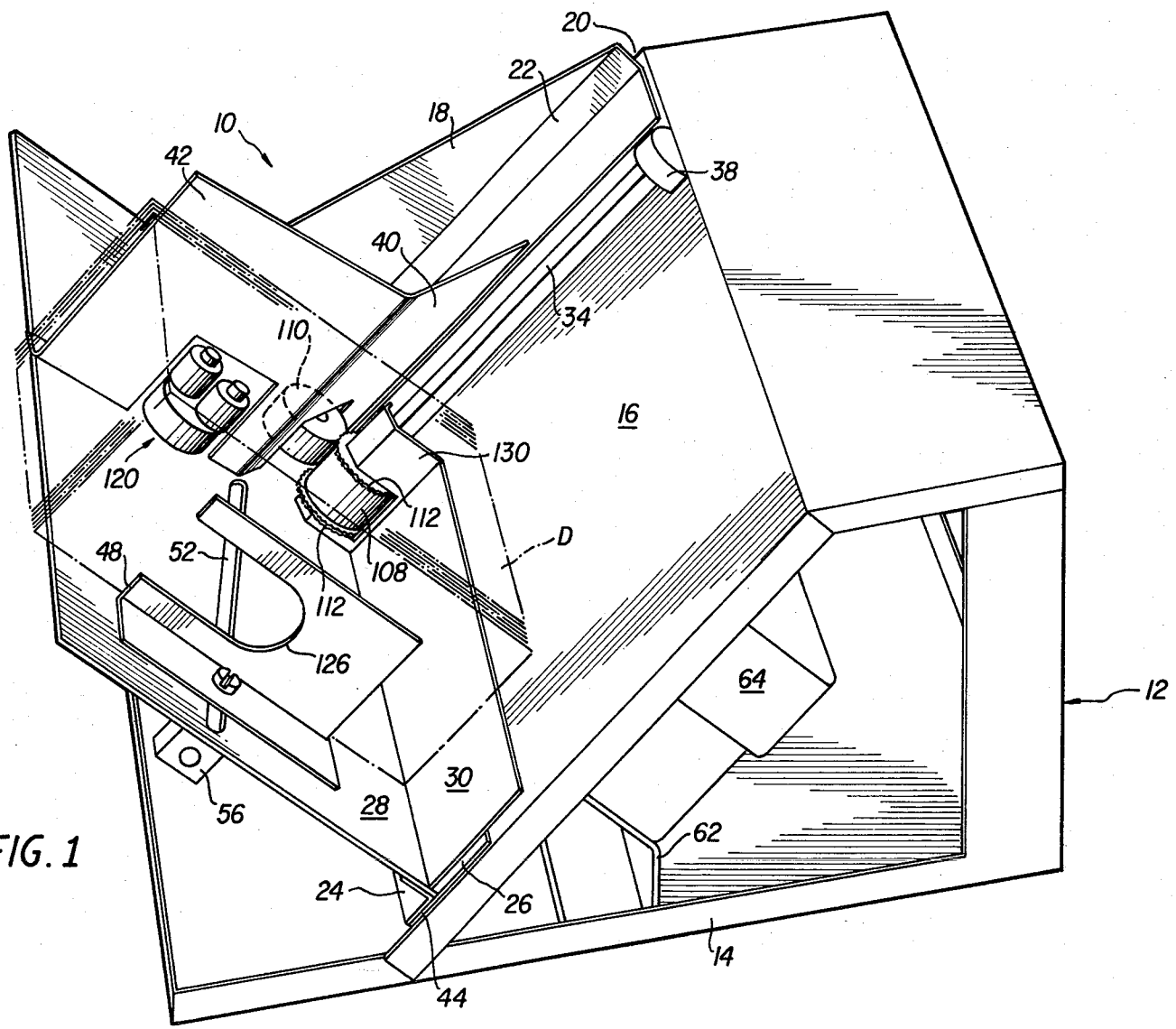
FIG. 1 is a perspective view of a document stacking apparatus constructed in accordance with the present invention.
Figure 3:
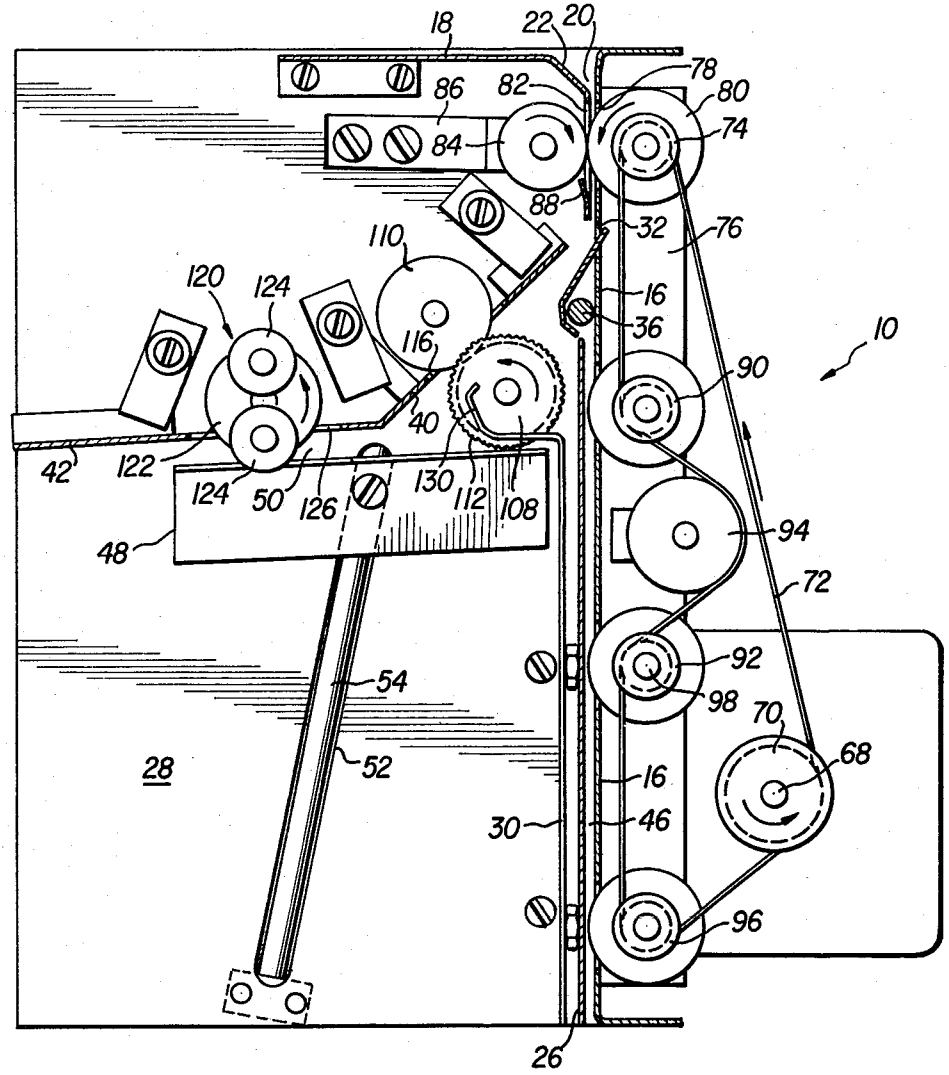
FIG. 3 is a cross-sectional view of the apparatus of FIG. 2 taken along the line 3—3 of FIG. 2.

Referring now to the drawings and more particularly to FIGS. 1 and 3 thereof, the stacking apparatus of the present invention is shown and generally indicated by reference character 10. The apparatus includes a housing frame, generally indicated by reference character 12, the sides and rear of which are open and the bottom of which serves as a support base for the apparatus. The housing frame 12 also includes an inclined face plate 16 which, together with a substantially L-shaped in-feed guide plate 18 spaced from, yet secured to plate 16, defines a document entrance or in-feed slot 20. The corner section 22 of guide plate 18 is beveled or angled so as to facilitate the insertion of the documents into in-feed slot 20.

A metal angle 24 is fixedly secured to the lower end of face plate 16 through means of an intermediary spacer plate 26. A document stacking base plate 28 is fixedly secured to the cantilevered leg of metal angle 24, and a document stacking end plate 30 is fixedly secured to the upper region of spacer plate 26. In this manner, stacking plates 28 and 30 form a document stacking bed upon which the stacked documents, shown in phantom in FIG. 1, are deposited during the stacking process.

Face plate 16 is provided with an elongated slot 32 within the vicinity of the downstream end of that portion of in-feed guide plate 18 defining in-feed slot 20. The slot 32 extends substantially the entire height of face plate 16 and is adapted to operatively cooperate with the upstream end of a pivotable deflector 34. The upper end of the deflector has its pivot pin 36 disposed within a journal housing 38 secured to face plate 16, while the lower end of the deflector is similarly secured within stacking base plate 28.

A document guide plate has two mutually bent portions 40 and 42 with the angle defined therebetween being obtuse. Plate section 40 is disposed substantially parallel to the primary surface of deflector 34; in this manner, such structures cooperate to define the document flow path downstream of in-feed slot 20 when the deflector 34 is disposed in the position shown in FIG. 3. When stacking of documents D, shown in phantom in FIG. 1, is not desired, the documents may be permitted to flow straight through the apparatus along a rectilinear path which is continuous with the path originally defined within in-feed slot 20. In order to achieve such processing, the deflector 34 is pivoted counterclockwise as viewed in FIG. 3 such that the upstream end thereof is withdrawn from the slot 32 to such an extent that the documents are no longer intercepted by the deflector. As may also be appreciated from FIGS. 2 and 3, intermediary spacer plate 26 is itself spaced from face plate 16 by means of a spacer plate 44. As a result, a document flow channel 46 is defined between face plate 16 and intermediary spacer plate 26 whereby non-stacked documents may be conducted through the stacking apparatus additional document processing equipment.

Figure 5:
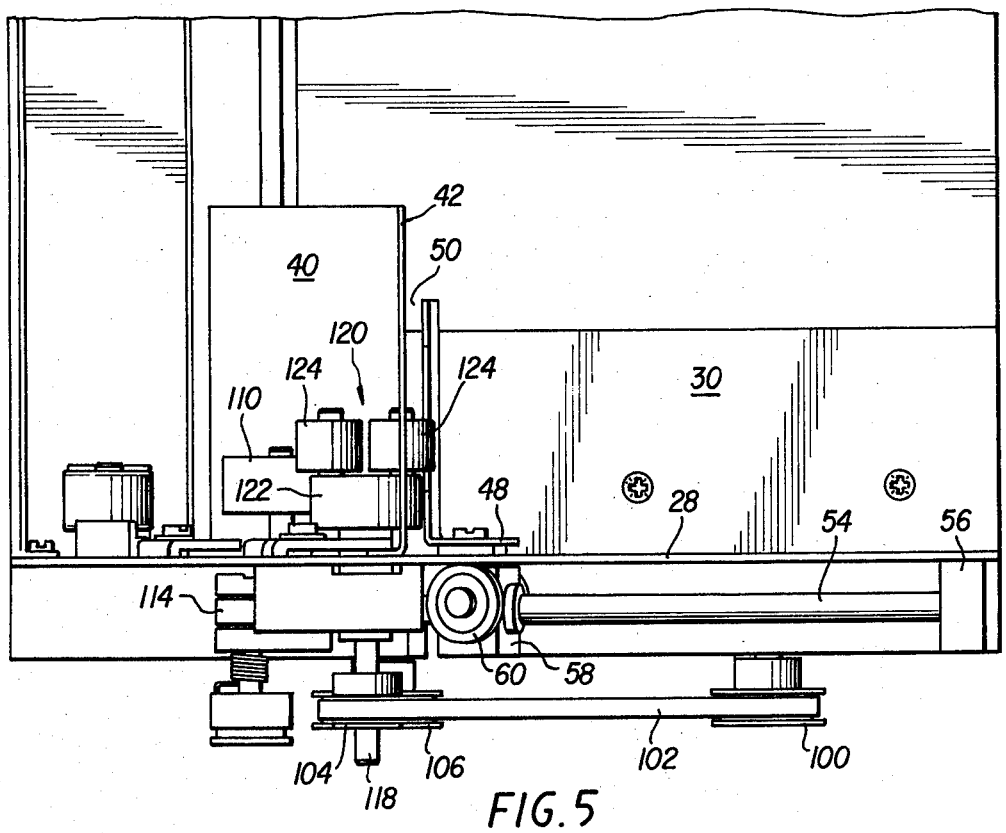
FIG. 5 is a cross-sectional view of the apparatus of FIG. 4 taken along the line 5—5 of FIG. 4.

In order to facilitate the actual stacking of the documents D upon the stacking bed of the apparatus a movable, substantially L-shaped baffle 48 is mounted upon stacking bed base plate 28. The upstanding leg of baffle 48 is disposed substantially parallel to document guide plate section 42; in this manner, as the documents are fed along the path defined by guide plate section 40 and deflector 34, the forward edges of the documents will encounter baffle 48 and be conducted into a stacking channel 50 defined between baffle 48 and guide plate section 42. The channel 50, as best illustrated by FIG. 5, is open-ended and can accordingly receive documents of various sizes without adjustment.

When it is desired to stack a substantial number of documents D within stacking channel or cavity 50, it is readily appreciated that the same must be continuously expanded in order to accommodate the documents as they are being processed and stacked. As can best be appreciated from FIGS. 1 and 2, the document stacking plates 28 and 30 are disposed in mutually orthogonal planes and each plane is, in turn, disposed at an angle, e.g. 45°, with respect to the apparatus base 14. Document stacking base plate 28 is provided with an elongated slot 52 which is inclined downwardly from the downstream or stacking side of the apparatus toward the upstream or in-feed side of the apparatus.

Figure 2:
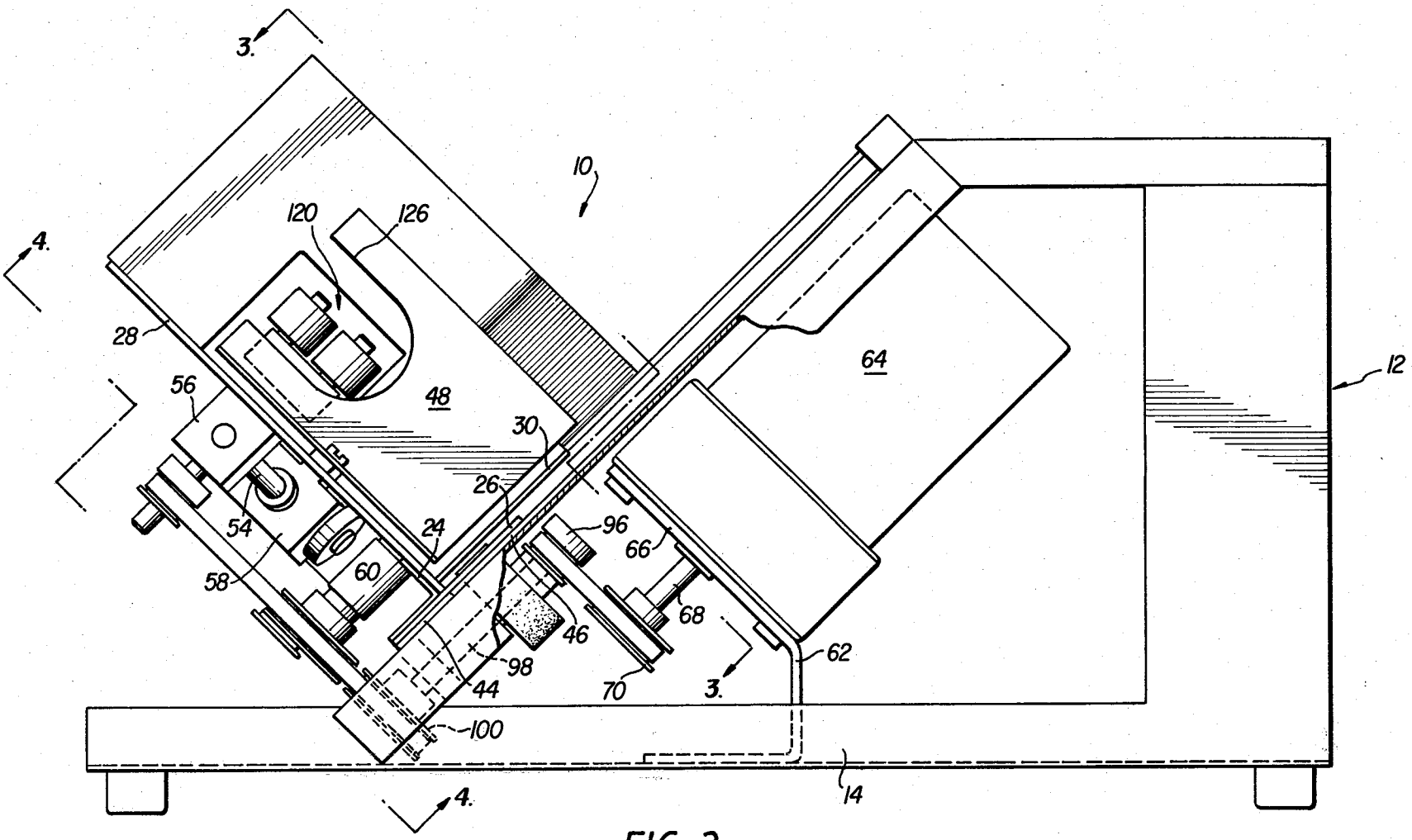
FIG. 2 is a side elevation view of the apparatus of FIG. 1.

A shaft 54, disposed parallel to and spaced beneath slot 52, has its opposite ends fixed within mounting blocks 56, the latter of which are secured to the undersurface of stacking bed base plate 28. A substantially inverted T-shaped collar 58, axially slidable upon shaft 54, has a stem portion thereof projecting upwardly through slot 52 so as to fixedly support baffle 48 in spaced relation above the plane of bed base plate 28. As a result of the aforenoted inclination of base plate 28 and slot 52, it will be seen that baffle 48 is gravity-actuated and tends to normally assume its position shown in FIG. 3 adjacent guide plate section 42. As the documents D are successively stacked upon plates 28 and 30, baffle 48 will simply move in the downstream direction, against the biasing force of gravity, along the path defined by slot 52, ball bushing mount 58 and shaft 54. In order to minimize friction between ball bushing mount 58 and the undersurface of plate 28, a pair of rollers 60 are rotatably mounted upon the opposite sides of ball bushing mount 58. The diametrical extents of the rollers, as well as the roller axes, are predetermined such that only the rollers are engaged with the undersurface of plate 28, the body of ball bushing mount 58 being spaced therebeneath as seen in FIG. 2. As baffle 48 is moved in its downstream direction, cavity 50 is expanded so as to accommodate the successively incoming documents. The baffle can only be moved along the traight line formed by slot 52, otherwise remaining in a substantially stable position. The baffle cannot be operatively moved in any other direction.

Figure 4:
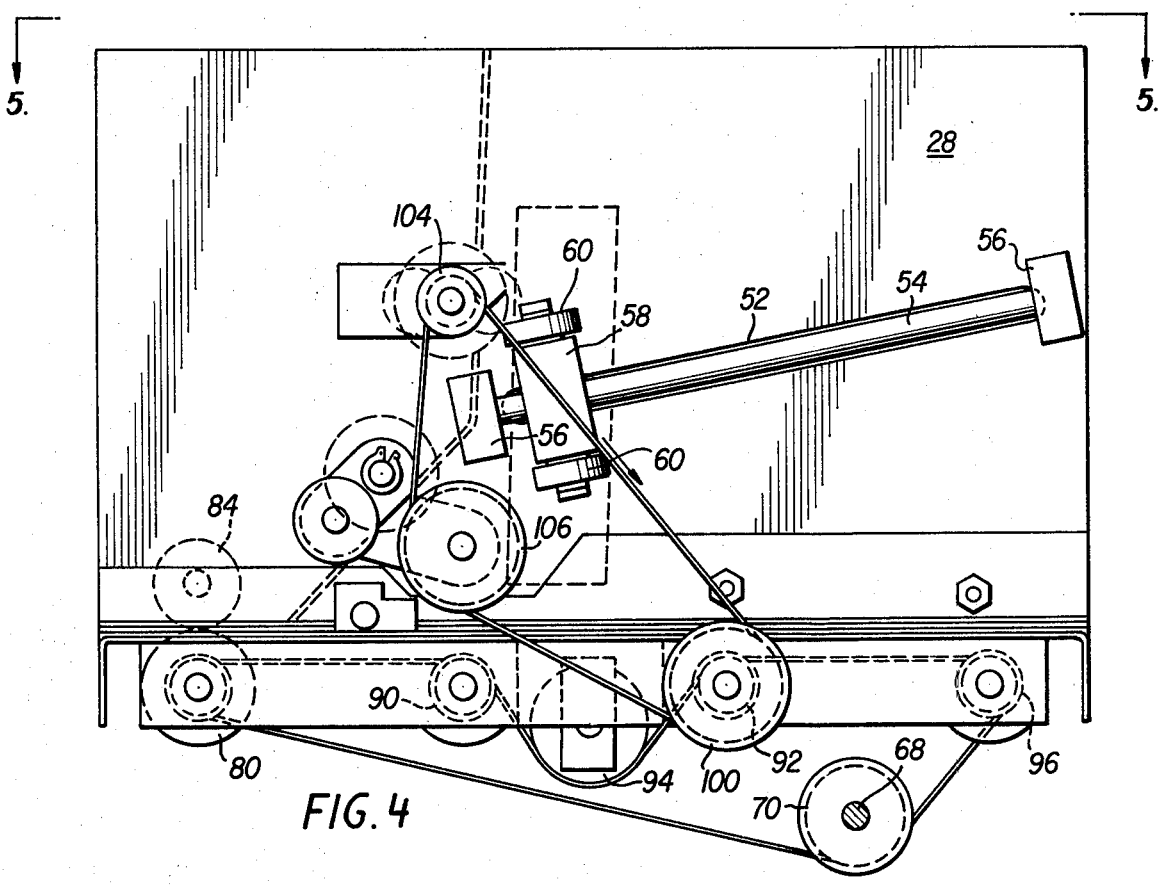
FIG. 4 is a cross-sectional view of the apparatus of FIG. 2 taken along the line 4—4 of FIG. 2.

A motor mounting bracket 62 is secured to the apparatus base 14 and has a drive motor 64 fixedly mounted thereon. Bracket 62 includes an inclined support section 66 disposed substantially perpendicular to face plate 16 such that the motor drive shaft 68 will extend through bracket section 66 parallel to face plate 16. As best seen in FIGS. 2-4, the dependent end of motor drive shaft 68 is provided with a first power drive pulley 70 the periphery of which is provided with axially extending grooves so as to define teeth (not shown) for drivingly engaging a similarly toothed pulley belt 72.

Belt 72 is trained about a second power drive pulley 74 which is rotatably mounted upon a mounting block 76 secured to the undersurface of face plate 16. As seen in FIG. 3, the lower portion of face plate 16 within the vicinity of in-feed slot 20 is provided with a slot 78 through which a portion of the periphery of a power drive roller 80, mounted upon the lower end of the pulley shaft of pulley 74, extends. The lower portion of in-feed guide plate 18 is likewise provided with a slot 82 so as to similarly permit a portion of the periphery of pressure roller 84 to extend therethrough and into contact with drive roller 80 so as to form a nip for conveying the documents into the stacking apparatus. The pressure roller 84 is fixedly secured to bed base plate 28 by means of a bracket 86. The downstream portion 88 of plate 18, which defines slot 82 in part, is bent away from the cooperating and corresponding portion of face plate 16 defining therewith in-feed slot 20 so as to insure that the flow of incoming documents is not obstructed.

A pair of power drive pulleys 90 and 92 are rotatably mounted upon the central portion of mounting block 76 and a tension idler roller 94 is interposed therebetween such that the pulley belt 72 traverses a sinusoidal path therearound. A fifth power drive pulley 96 is also mounted upon mounting block 76 at the end thereof opposite that upon which the second pulley 74 is mounted.

A drive shaft 98 of pulley 92 extends downwardly through the mounting block 76 and the lowermost end thereof has a sixth power drive pulley 100 mounted thereon. A second pulley belt 102 is trained about pulley 100 and is likewise engaged with a seventh powerdrive pulley 104. The drive train including belt 102 and pulleys 100 and 104 is completed by means of an eighth power drive pulley 106, the pulleys 100, 104 and 106 being arranged in a triangular array as best seen in FIG. 4.

The eighth power drive pulley 106 has an upstanding shaft upon which is rotatably mounted a second power drive roller 108. The shaft of pulley 106 passes upwardly through bed stacking plate 28 so as to dispose power drive roller 108 above the plate 28. An idler pressure roller 110 is also disposed above plate 28 so as to cooperate with drive roller 108 in defining a document conveying nip in a manner similar to that defined by rollers 80 and 84. Rubber caps 112, having toothed peripheries, are secured to the upper and lower surfaces of drive roller 108; the diameters of such caps are greater than that of roller 108. However, as the caps are disposed above and below the pressure roller 110, the caps do not interfere with the document driving nip defined by means of rollers 108 and 110. In addition, the toothed peripheries tend to grasp the rear edges of the documents as they are being conveyed through the nip defined by rollers 108 and 110 and cause the document rear edges to be diverted toward baffle 48. As roller 110 may be fabricated of metal, as opposed to the fabrication of roller 84, of, e.g. rubber, the roller 110 is pivotably mounted upon a spring biased support block 114 such that thicker documents may be easily accommodated and processed through the nip defined by rollers 108 and 110 without jamming of the apparatus. In a manner similar to the disposition of rollers 80 and 84 relative to plates 16 and 18, respectively, plate section 40 is provided with a slot 116 so as to permit a peripheral portion of roller 110 to extend therethrough and cooperatively engage roller 108.

Lastly, it is also seen that pulley 104 has an upstanding shaft 118 which passes through bed plate 28; a document braking or retarding roller system, generally indicated by the reference character 120, is rotatably mounted thereon. The system includes a base or support roller 122 and a pair of smaller rollers 124 mounted thereon. The axes of rollers 124 are fixed upon roller 122, however, the rollers 124 are freely rotatable. An opening or slot 126 is defined within plate section 42 and a peripheral portion of the support roller 122 extends therethrough and into the document conveying path. As seen from the FIGURES, the peripheries of rollers 124 are disposed radially outwardly of the periphery of support roller 122, with rollers 124 likewise extending through slot 126. A U-shaped opening 128 is also defined within baffle 48 whereby rollers 124 may freely rotate within document conveying channel 50 without interference with baffle 48 when the stacking operation is initiated and the baffle 48 is disposed in the position shown in FIG. 3.

It is particularly noted that the angular rotation of rollers 122 and 124 is opposite that required for conveyance of the documents so that a braking or retarding function is thereby imparted to the documents. The rollers 122 and 124 do not block passage of the forward edges of the documents; to the contrary, the force of the documents conveyed by means of the roller drives 80–84 and 108–110 is sufficiently powerful so that when the documents encounter baffle 48, the same is moved away from channel 50 and the documents tend to pass by rollers 122 and 124. However, as the documents are nevertheless caught between the rollers 122 and 124 and baffle 48 or previously stacked documents, the documents being conveyed do not entirely pass by or escape beyond the rollers 122 and 124 and are in fact retarded to the proper extent so as to be stacked within the apparatus as desired. As seen from FIGS. 1 and 3, the upstream end of stacking end plate 30 is also provided with a substantially arcuate portion 130 which overhangs drive roller 108. Portion 130 tends to smoothly guide the trailing edges of the documents against the baffle 48 or previously stacked documents and in addition cooperates with rollers 122 and 124 in maintaining the documents stacked against baffle 48 or previously stacked documents.

Obviously, many modifications and variations are possible in light of the above teachings. It is therefore to be understood that, within the scope of the appended claims, the present invention may be practiced otherwise than as specifically described herein.

What is claimed is:

1. Document stacking apparatus for continuously stacking a plurality of documents in the sequential order in which they are fed into said apparatus, comprising:

bed means inclined with respect to the horizontal plane upon which documents to be stacked can be deposited;

means for feeding said documents into said apparatus;

document guide means for guiding said documents along an open-ended predetermined path from said feeding means;

deflecting means operatively cooperable with said guide means for defining said predetermined path;

a baffle movably mounted upon said bed means and operatively cooperable with said guide means for defining a stacking cavity, said baffle being biased toward a first position whereby said stacking cavity is minimized and being moveable under the influence of incoming documents to be stacked against said bias toward a second position so as to expand said stacking cavity and accommodate successive documents to be stacked, said baffle being slidably disposed upon said bed means between said first and second positions and being of a length sufficient to accommodate variously sized documents without adjustment and being movable only along a line between said first and said second positions in order to accept said plurality of documents, said baffle otherwise remaining in a substantially stable position; and document retarding means disposed adjacent one end of said predetermined path and rotatable in a direction counter to that which would normally feed said documents along said predetermined path for retarding the conveyance of said documents to be stacked so as to prevent the escape of said documents to be stacked from said stacking cavity and to facilitate the stacking of said documents within said stacking cavity.

2. Document stacking apparatus for continuously stacking a plurality of documents in the sequential order in which they are fed into said apparatus, comprising:

bed means upon which documents to be stacked may be deposited;

means for feeding said documents into said apparatus;

document guide means for guiding said documents along an open-ended predetermined path from said feeding means;

deflecting means operatively cooperable with said guide means for defining said predetermined path;

baffle means movably mounted upon said bed means and operatively cooperable with said guide means for defining a stacking cavity; and means disposed within said predetermined path for retarding the conveyance of said documents to be stacked so as to prevent the escape of said documents to be stacked from said stacking cavity and to facilitate the stacking of said documents within said stacking cavity, said retarding means comprising at least one roller having an angular rotation opposite to that required for conveying said documents and being located adjacent an open end of said path in order to terminate the movement of said documents at said end.

3. Apparatus as set forth in claim 2, wherein said baffle means is gravity-biased toward a first position whereby said stacking cavity is minimized and is movable, under the influence of incoming documents to be stacked, against the gravity-bias toward a second position so as to expand said stacking cavity and accommodate successive documents to be stacked.

4. Apparatus as set forth in claim 3, wherein:

said bed means is inclined with respect to the horizontal plane; and said baffle means is slideably disposed upon said bed means between said first and second positions.

5. Apparatus as set forth in claim 4, further comprising:

means defining an inclined slot within said bed means; and means fixedly supporting said baffle means and operatively cooperable with said slot defining means for guiding said baffle means along said slot means between said first and second positions.

* * * * *